US006647683B1

(12) United States Patent
Thomsen et al.

(10) Patent No.: US 6,647,683 B1
(45) Date of Patent: Nov. 18, 2003

(54) DRAINAGE AND SEALING SYSTEM AND A PANEL SYSTEM COMPRISING SUCH A SYSTEM

(75) Inventors: Morten Werner Thomsen, Roskilde (DK); Hans Ove Pedersen, Værløse (DK); Lars Helmersen, Jyllinge (DK); Vagn Einfeldt Jensen, Roskilde (DK); Aage Mathiassen Wind, Lynge (DK); Niels Birkedal Kristiansen, Copenhagen (DK)

(73) Assignee: VKR Holding A/S, Søborg (DK)

( * ) Notice: Subject to any disclaimer, the term of this patent is extended or adjusted under 35 U.S.C. 154(b) by 0 days.

(21) Appl. No.: 09/959,331

(22) PCT Filed: Apr. 18, 2000

(86) PCT No.: PCT/DK00/00201

§ 371 (c)(1),
(2), (4) Date: Feb. 14, 2002

(87) PCT Pub. No.: WO00/65173

PCT Pub. Date: Nov. 2, 2000

(30) Foreign Application Priority Data

Apr. 23, 1999 (DK) ..... PA 1999 00555

(51) Int. Cl.[7] ..... E04B 7/02

(52) U.S. Cl. ..... 52/302.1; 52/302.3; 52/209; 52/200

(58) Field of Search ..... 52/302.1, 302.3, 52/302.6, 308, 209, 97, 72, 200, 204.51

(56) References Cited

U.S. PATENT DOCUMENTS

| | | | | | |
|---|---|---|---|---|---|
| 2,963,126 | A | * | 12/1960 | Cudini | 52/302.6 |
| 4,114,330 | A | * | 9/1978 | Sukolics | 52/200 |
| 4,327,532 | A | * | 5/1982 | Matthews | 52/92.2 |
| 5,074,089 | A | | 12/1991 | Kemmer et al. | |
| 5,373,671 | A | * | 12/1994 | Roth et al. | 52/204.1 |
| 5,797,225 | A | * | 8/1998 | Ishikawa | 52/93.1 |
| 5,839,236 | A | * | 11/1998 | Frey | 52/235 |
| 5,890,331 | A | * | 4/1999 | Hope | 52/209 |
| 6,223,481 | B1 | * | 5/2001 | Rickman | 52/90.1 |

FOREIGN PATENT DOCUMENTS

| | | |
|---|---|---|
| DK | 165509 B | 12/1992 |
| EP | 0 218 969 | 4/1987 |
| EP | 0 518 222 A1 | 12/1992 |
| FR | 2653856 | 5/1991 |
| WO | WO 87/06291 | 10/1987 |
| WO | WO 93/16249 | 8/1993 |

OTHER PUBLICATIONS

Extract from the textbook "Facedeelementer," the Technical University of Denmark, 1971.

* cited by examiner

*Primary Examiner*—Carl D. Friedman
*Assistant Examiner*—Basil Katcheves
(74) *Attorney, Agent, or Firm*—Venable LLP; John P. Shannon; Chad C. Anderson

(57) ABSTRACT

In the drainage and sealing system, an external rain shield is designed as a separate flexible sealant strip (38,58,59), and an internal drain trench (44, 64) is provided on a separate drain element (40, 60) extending in parallel to and at a distance from the external sealant strip (38, 58, 59). The drain element (40) and the external sealant strip (38) comprise a flange portion (41, 38*b*) for releasable securing to a frame member of a panel in the panel system. The separate drain element (40, 60) can be designed as an internal cover strip where the drain trench (44, 64) is provided in an essentially U-shaped portion (43, 63), and where the drain element on the side facing away from the drain trench (44, 64) has a portion (42, 62) for reception of an internal sealant strip (45, 65).

17 Claims, 3 Drawing Sheets

Figure 1:
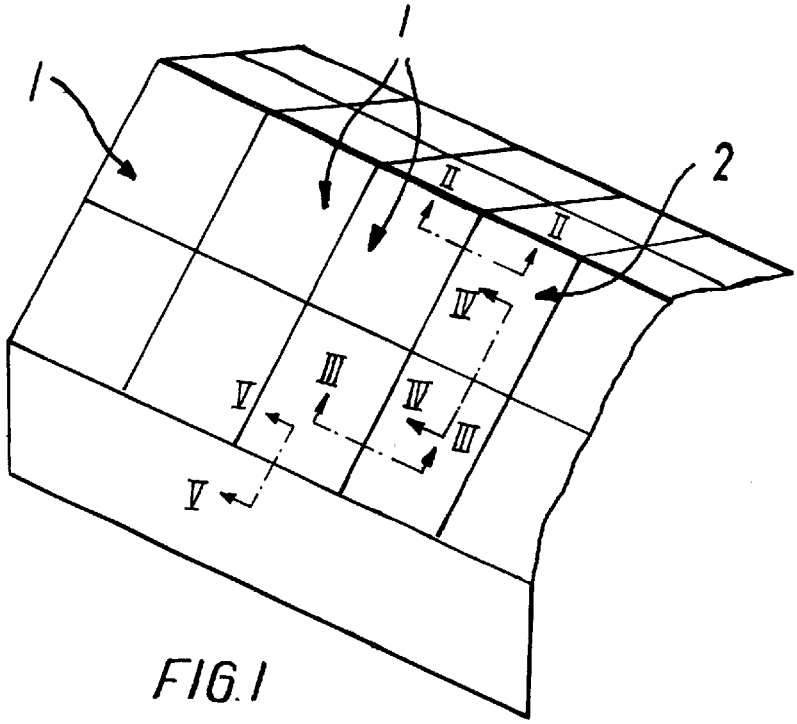

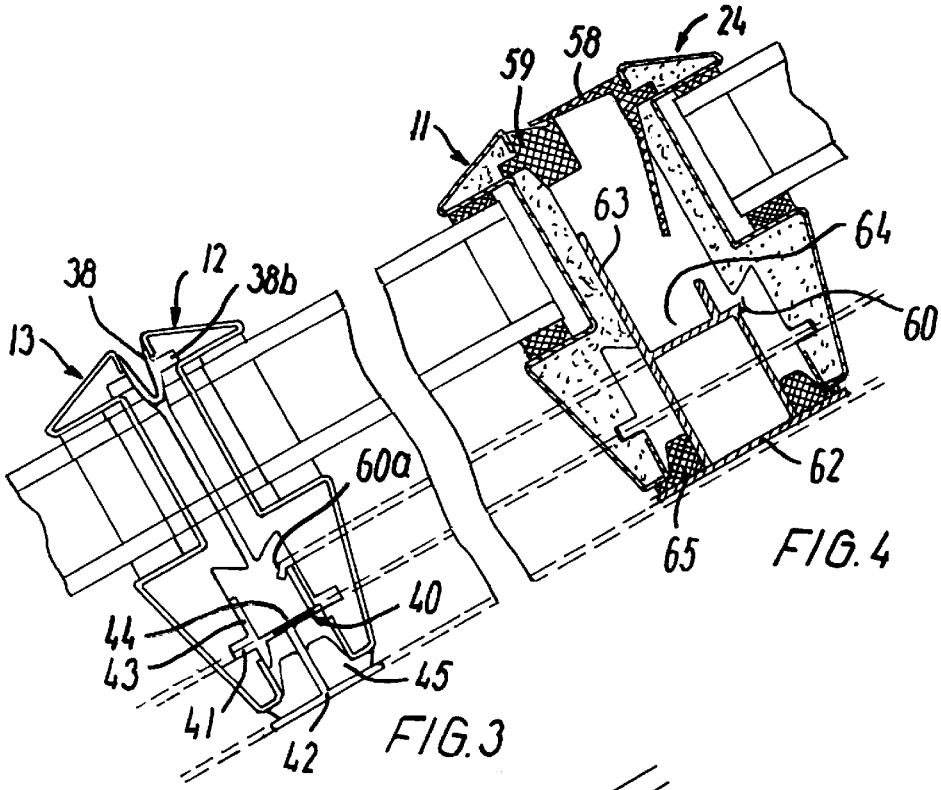
FIG. 3
FIG. 4
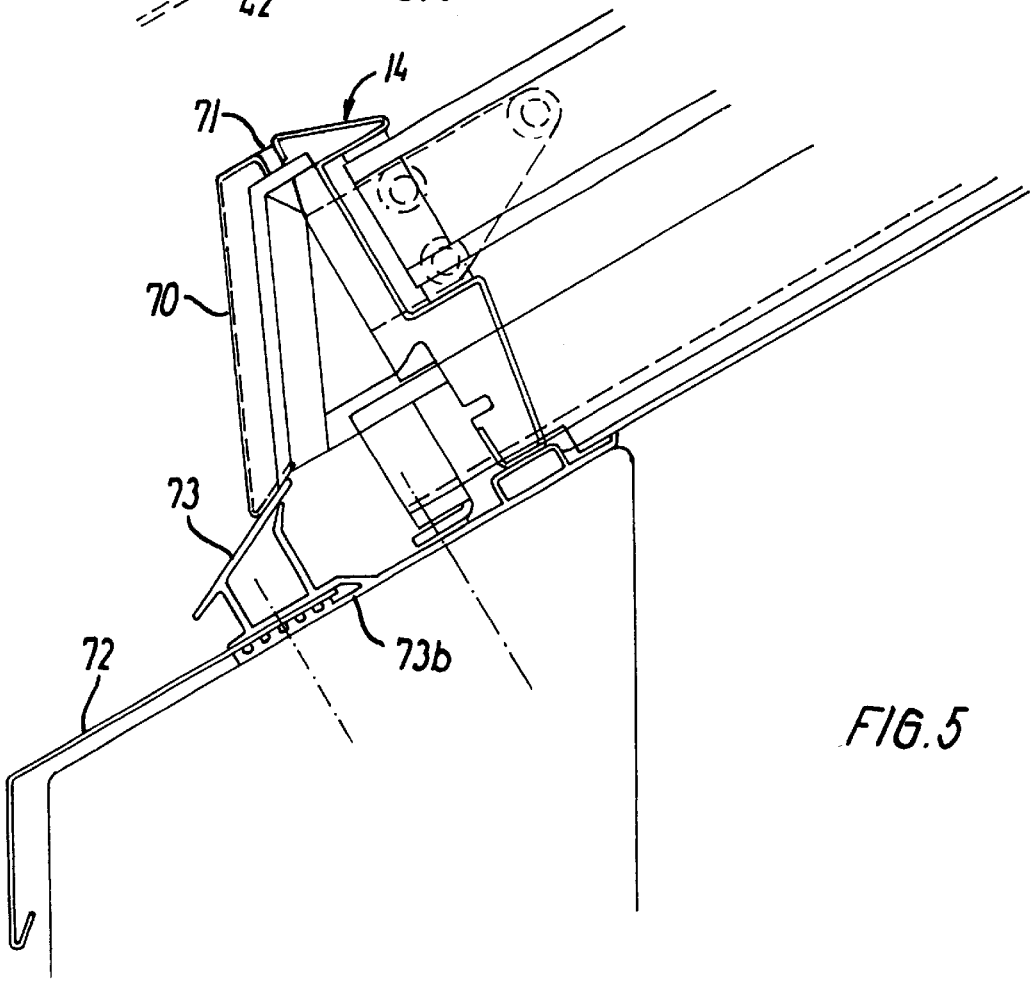
FIG. 5

DRAINAGE AND SEALING SYSTEM AND A PANEL SYSTEM COMPRISING SUCH A SYSTEM

The present invention relates to a drainage and sealing system for use in connection with a panel system constructed as e.g. a panel fillet or a major panel surface to be mounted in a pitched roof or in a facade, comprising a number of fixed panels together with a number of openable panels, each panel comprising a frame composed of frame members bordering a panelling element between them, in which between adjacent frame members of at least openable panels placed next to and above each other, at least one external rain shield and an internal sealant strip are extending over a major part of the length of the frame member, and in which at least along the frame members in the adjacent panels for openable panels between the external rain shield and the internal sealant strip, at least one internal drain trench is provided for drainage of water.

Such systems are used to assure, that water and other precipitation can be drained in a reliable way such that no water penetrates in the structure placed within or below the panel system.

In this connection, it is important to have at least two sealing systems mutually separated in each their usually coherent sealing planes in order thus in part to form a relief chamber (pressure equalizing), in part to provide space for insertion of a drain trench such that the lower or internal sealant strip is kept dry. In general, there is thus an external and an internal sealing plane where the external plane forms a primary water drainage shield. The drain trench is conventionally designed integrally with the frame member.

Such a solution is, however, expensive to construct and provides no space for flexibility in the design of the components of the panel system.

Therefore, the object of the invention is a drainage and sealing system of the initially stated kind where a tight and secure connection between the panels placed next to and upon each other, and at the same time the drainage and sealing system must be able to provide the desired flexibility in the design of the frame structure.

This object is obtained by a drainage and sealing system which is characterized in that the external rain shield is designed as a separate flexible sealant strip and that the internal drain trench is provided on a separate drain element extending in parallel to and at a distance from the external sealant strip.

Designing the external rain shield as a sealant strip results in a simple construction and at the same time a good capacity of water drainage is assured and where the sealant strip provides the necessary tightness between adjacent panels. In providing a separate drain element, the frame structure can be designed in any appropriate way without affecting the drainage of water likely to be gathered in the drain trench which also serves as an additional security against penetration of water.

Preferably, the drain element and the external sealant strip comprise means for releasable securing to a frame member where the means are preferably constituted by a flange portion. In this design, the drain element can be reversed if it is desired to make a fixed panel openable and vice versa.

In another aspect a panel system is provided where engagement means are arranged in each frame member for releasable securing of the sealant strip and drain trench.

Further advantages can be obtained in the features stated in the dependant claims.

Figure 2:
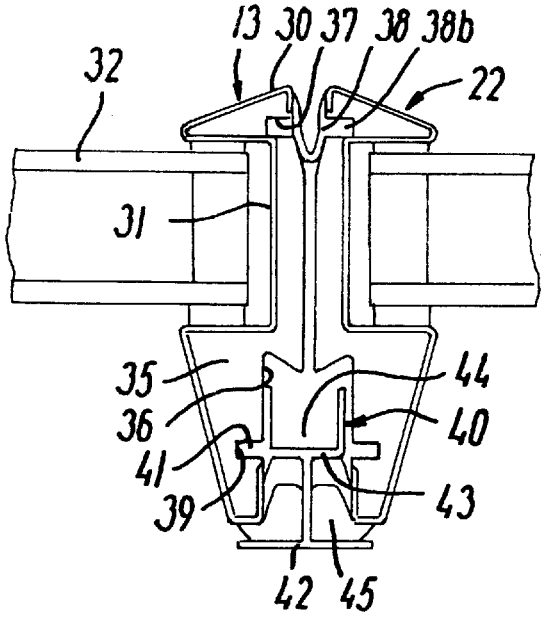
Figure 6:
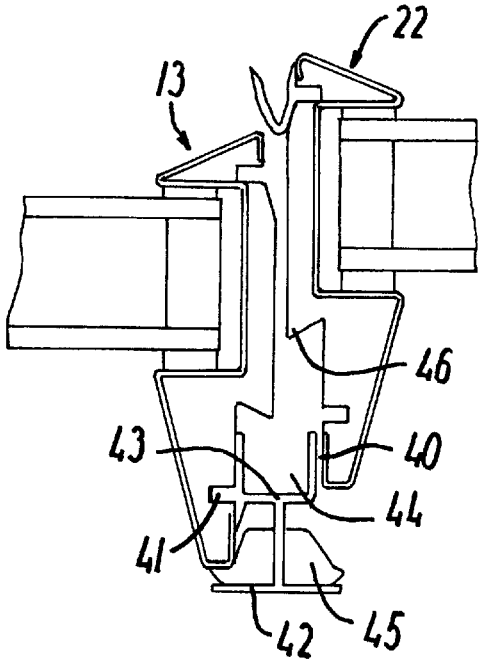
Figure 7:
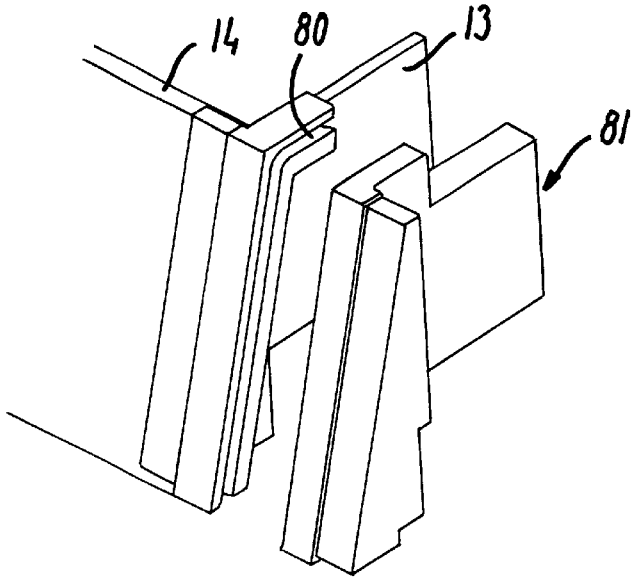
Figure 8:
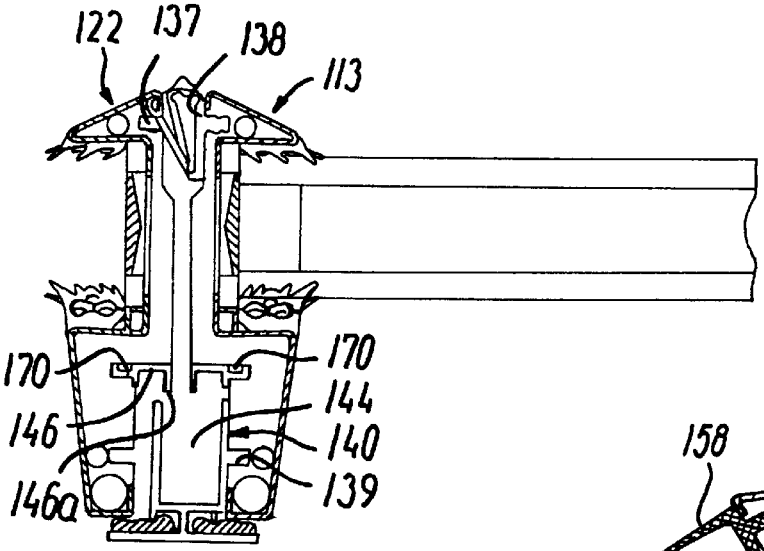
Figure 9:
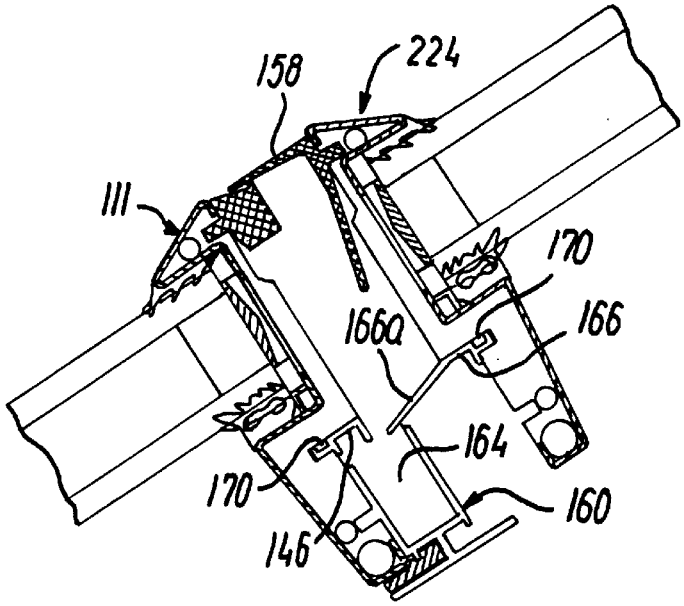

In the following the invention is explained in more detail with reference to the schematic drawing where FIG. 1 shows a section of a panel system according to the invention, FIG. 2 is a sectional view along the line II—II in FIG. 1, FIG. 3 is a sectional view along the line III—III in FIG. 1, FIG. 4 is a sectional view along the line IV—IV in FIG. 1, FIG. 5 is a sectional view along the line V—V in FIG. 1, FIG. 6 is a view corresponding to FIG. 2 in an open position of the openable panel in the panel system according to the invention, FIG. 7 is a perspective view of a detail in an alternative embodiment of the panel system, FIG. 8 is a view corresponding to FIG. 2 of an alternative embodiment of a panel system according to the invention, and FIG. 9 is a view corresponding to FIG. 4 of the alternative embodiment of the panel system shown in FIG. 8.

FIG. 1 shows a section of a panel system with a drainage and sealing system according to the invention. The panel system can e.g. be designed to form part of a panel fillet or another major panel surface which in the shown embodiment constitutes at least one part of a glass roof.

The panel system comprises a number of fixed panels 1 together with one or more openable panels 2, in the shown section one. Each panel 1, 2 comprises an essentially rectangular frame structure with four frame members, i.e. a top member 11, two side members 12, 13 and a bottom member 14 (cf. FIGS. 2–4) of the fixed panel 1 and correspondingly a top member, two side members 22 and a bottom member 24 for the openable panel 2. The openable panel 2 is at its top member hingedly connected to the subjacent structure. The panels can be used for many other different geometrical constructions and thus have another shape than the shown rectangle, e.g. a triangular or another polygonal shape. The hinged connection can further be provided at the bottom member of the frame structure or one of its side members.

In the shown embodiment, the frame members are designed as uniform standard parts and the construction of e.g. the side frame members 13, 22 appears from the cross-sectional view of two adjacent panels 1,2 shown in FIG. 2.

The frame member 13 comprises thus in the shown embodiment a profile element 30 which is formed by roll forming of a metal sheet strip which may e.g. consist of stainless steel. In the profile element 30 a track 31 is provided for reception of an edge portion of a panelling element which in the shown embodiment is an insulating pane 32 but which also might be any other panelling element of the panel 1.

The frame member 13 comprises furthermore a core element 35 which on the side facing the side frame member 22 of the adjacent panel has a backing layer 36. It is to be understood that the frame member can obviously be designed integrally and consist of other materials, e.g. aluminium or wood.

The frame member 13 is provided with a first track 37 which as shown for the side frame member 22 of the adjacent panel 2 serves for reception of a flange portion 38b on an external sealant strip 38, and another track 39 for reception of a flange portion 41 on a separate drain element in the form of an internal cover strip 40 which on a reversed T-shaped bottom portion 42 further carries an internal sealant strip 45 and which in a U-shaped top portion 43 delimits a drain trench 44. Opposite the cover strip 40, the frame member 13 is provided with a drip cap 46 for controlled discharge of water. The tracks 37, 39 can in a way not shown further be provided with ribs for improved securing of the sealant strip 38 and the cover strip 40, respectively. As the cover strip 40 is only provided with a flange portion 41 in one side and otherwise is formed symmetrically, it can be reversed such that the flange portion 41 projects in the track 39 in the side frame member 22 of the right panel 2 in FIGS. 2 and 6 if it is desired to make the left panel 1 openable and the right panel 2 fixed. The sealant strip 38 can also be reversed such that the flange portion 38*b* projects in the track 37 in the frame member 13. Not only because of aesthetics, a cover element, not shown, with form and colour according to the client's desire is provided on the cover strip 40 such that this cannot be seen from the inside.

In the embodiment in FIGS. 8 and 9, where parts with the same or analogous function as in the embodiment in FIGS. 2–7 have the same referential number added with 100, an additional track 170 besides the tracks 137, 139 is formed in each frame member, in which track a separate drip cap element 146 and 166, respectively, is received. The separate drip cap element 146, 166 can e.g. be designed as a profile inserted in the track 170 by means of any suitable releasable securing principle. In the frame members shown in FIG. 8 constituting the adjacent frame members of two juxtaposed panels, an element 146 is provided in each frame member, and the drip cap elements have an external flange portion 146*a* which is essentially flush with the inner edge of the frame member, and which is to assure that water which may penetrate past the external sealant strip 138 is led down in the drain trench 144 of the cover strip 140. In the joint between the superimposed panels shown in FIG. 9, the drip cap element 166 inserted in the track 170 of the top frame member has also an external flange portion 166*a*, however, with an essentially increased length in relation to the flange portion 146*a* on the drip cap element 146 in the bottom frame member to assure that the water is led down to the drain trench 164. The design of the drip cap element can be varied among other in dependence of the position in the panel system. At the top member of a panel, a membrane can thus be received in the track 170.

As appears from FIG. 2, the side frame member 22 of the openable panel 2 is constructed in exactly the same way as in the above described side frame member 13 of the fixed panel 1. Correspondingly, it applies that the general shape of the frame members is identical for top, bottom and side members of both fixed and openable panels, however, this is no requirement and is not deciding for the invention.

In the following, the drainage of water from the panel system will be explained, mainly with reference to the embodiment shown in FIGS. 2–7, however, it is to be understood that the use of separate drip cap elements as shown in FIGS. 8 and 9 results in essentially the same water conduit process.

On a panel system mounted in a pitched roof, water stemming from rain, snow or other precipitation is usually transported in the longitudinal direction of the panels, i.e. in parallel to the side members of the frame structures. The major part of this surface water will, of course, run over the panels themselves, whereas a smaller part will run along the flexible sealant strip 38 between adjacent frame members in neighbouring panels.

At the end of the panel system, the sealant strip 38 is led via a track not shown in FIG. 7 facing the bottom member 14 and corresponding to the track 80 provided in a separate end piece 81 at the bottom member 14. Thus is assured that the external sealing plane is kept unbroken on the entire length down to and by the external side of the bottom panel member 14, and at its end preferably out on the adjacent bottom sealant strip.

At the joint between the superimposed panels, the water is led in the shown embodiment via external sealant strips 58, 59 as shown in FIG. 4.

At the bottom end of the panel system, the surface water is led, as appears from FIG. 5, out on the roof surface and further to a not-shown roof gutter system via a cover shield 70 which is connected to bottom frame member 14 by means of a sealant strip 71, and a connection element 72.

Water that may penetrate past the external sealant strips 38, 58, 59 either because the openable panel 2 is open during periods with precipitation, or due to leaks in the sealant strips or condensation water or bilge water is led away and out from the system in the following way.

At the side edges of the panels, water from the outside is led along e.g. the surface of the side frame members 13, 22 whereby the drip cap 46 alternatively the drip cap element 146 assures that the water drips exactly down in the drain trench 44 in the drain element 40. The drain trench of the drain element prevents thus that water penetrates further in the structure past the internal weather strip 45.

The water is led in the drain trench 44 along the length of the drain element 40, and as this extends over essentially the entire length of the panel system in the direction of the roof pitch, the water can be diverted at the end of the system, as shown in FIG. 5, and further out past a sealant strip 73 placed under the bottom frame member 14, and which with a projecting, split flange portion 73*b* is connected to the connection element 72. The water is led through a form of maze with weepholes mutually displaced in the longitudinal direction of the sealant strip which extends in parallel with the longitudinal direction of the bottom frame member 14.

Also water collected at horizontal joints between superimposed panels of both fixed and openable panels is diverted via the drain trench 44, because the drain element 60 as it appears from FIG. 4 in combination with FIG. 3 has a drain trench 64 which is positioned higher up or nearer the top sealing plane represented at the sealant strips 58, 59 than the drain trench 44. The water is thus led along this drain trench 64 and out to its ends where it via a folded section 60*a* on the drain element 60 is in connection with the drain trench 44 whereupon the water is led down to the end of the panel system in the above way.

The invention is not limited to the above described embodiments, and the drainage and sealing system can, of course, also be used for other types of structures than the shown panel system.

What is claimed is:

1. A panel system having a drainage and sealing system, wherein the panel system is constructed as e.g. a panel fillet or a major panel surface to be mounted in a pitched roof or in a facade, the panel system comprising at least one fixed panel (1) together with at least one openable panel (2), each panel comprising a frame composed of frame members (11–14, 22, 24) bordering a panelling element (32) between them, in which, between adjacent frame members of at least the openable panel and a panel laterally adjacent to the openable panel, at least one external rain shield (38, 58, 59) and an internal sealant strip (45, 65) extend over a major part of the length of the adjacent frame members, and between the external rain shield and the internal sealant strip, at least one internal drain trench (44, 64) is provided for drainage of water, characterized in that the external rain shield is designed as a separate flexible external sealant strip (38, 58, 59) and that the internal drain trench (44, 64) is provided on a separate drain element (40, 60) extending in parallel to and at a distance from the external sealant strip (38, 58, 59).

2. A panel system according to claim 1, characterized in that said drain element (40) comprises means for releasable securing to a frame member.

3. A panel system according to claim 1, characterized in that said external sealant strip (38) comprises means for releasable securing to a frame member.

4. A panel system according to claim 1, characterized in that the separate drain element (40, 60) is designed as an internal cover strip, the drain trench (44, 64) is provided in an essentially U-shaped portion (43, 63), and the drain element on the side facing away from the drain trench (44, 64) has a portion (42, 62) for reception of the internal sealant strip (45, 65).

5. A panel system according to claim 1, wherein said external rain shield, said internal sealant strip and said internal drain trench are also between the openable panel and a vertically adjacent panel, characterized in that the drain element (60) placed between the openable panel and the vertically adjacent channel has a drain trench (64) extending over essentially the entire width of the panels and is placed closer to the external sealant strip (68) than is the drain trench (44) in the drain element (40) between laterally adjacent panels.

6. A panel system according to claim 5, characterized in that the drain trench (64) in the drain element (60) placed between vertically adjacent panels is connected at each end to the drain element (40) placed between laterally adjacent panels such that a connection is provided between the two drain trenches (64,44).

7. A panel system according to claim 1, characterized in that first engagement means are arranged in each frame member for releasable securing of said separate drain element (40, 60).

8. A panel system according to claim 7, characterized in that second engagement means are arranged in each frame member for releasable securing of said sealant strip (38, 58, 59).

9. A panel system according to claim 7, characterized in that a separate end piece (81) is provided in connection with at least one bottom member of the frame structure, which end piece has a track for reception of said external sealant strip.

10. A panel system according to claim 7, characterized in that each frame member comprises means (46, 66; 146, 166) for controlled derivation of water from the frame member to said drain element (40, 60; 140, 160).

11. A panel system according to claim 10, characterized in that said means for controlled derivation comprises a drip cap (46, 66) integrated with the frame member.

12. A panel system according to claim 10, characterized in that said means for controlled derivation comprises a separate drip cap element (146, 166), and third engagement means in each frame member for releasable securing of said drip cap element (146, 166).

13. A panel system according to claim 2, wherein said means for releasable securing comprises a flange portion.

14. A panel system according to claim 3, wherein said means for releasable securing comprises a flange portion.

15. A panel system according to claim 7, wherein said first engagement means comprises at least one track.

16. A panel system according to claim 8, wherein said second engagement means comprises at least one track.

17. A panel system according to claim 12, wherein said third engagement means comprises at least one track.

* * * * *